United States Patent [19]

Marris

[11] 4,455,702

[45] Jun. 26, 1984

[54] FOOTWEAR MANUFACTURE

[75] Inventor: Richard E. F. Marris, Kendal, England

[73] Assignee: K. Shoemakers Limited, Kendal, England

[21] Appl. No.: 340,270

[22] Filed: Jan. 18, 1982

[30] Foreign Application Priority Data

Jan. 16, 1981 [GB] United Kingdom ..... 8101318

[51] Int. Cl.[3] ..... A43D 9/00

[52] U.S. Cl. ..... 12/142 R; 12/1 R

[58] Field of Search ..... 12/142 R, 1 R, 1 A, 12/1 W

[56] References Cited

U.S. PATENT DOCUMENTS 3,419,929 1/1969 Snow et al. ..... 12/1 A 4,321,721 3/1982 Painter et al. ..... 12/1 W

*Primary Examiner*—Patrick D. Lawson

*Attorney, Agent, or Firm*—Fleit, Jacobson, Cohn & Price

[57] ABSTRACT

A method of manufacturing outer footwear such as a shoe comprises the step of dry or moist heat setting a lasted shoe (9, 10) by partially or totally immersing it in a fluidized solid material (2) in a bath (1). It is now proposed that the lasted shoe (9, 10) should be enclosed in a sleeve (7) of flexible impervious material, the upper open end (6) of the sleeve being fixed with respect to the bath (1) while the remainder of the sleeve including its closed end (7*a*) is partially or totally immersed in the fluidizable material. Apparatus for the performance of the method comprises a plurality of sleeves (9) fitted as aforesaid with their open upper ends (6) secured to the top (5) of the bath (1) and their lower closed ends (7*a*) secured by hooks (8) to the floor of the bath. The material is fluidized by admission of heated air to the bottom of the bath of which the top cover (5) has an air outlet (5*b*) including a filter for preventing escape of fluidized material.

5 Claims, 2 Drawing Figures

FOOTWEAR MANUFACTURE

This invention relates to a method of manufacturing footwear, such as a shoe, which comprises the step of dry or moist heat setting a lasted shoe with or without a protective covering by total or partial immersion in a bath of heated fluidized solid material such as fine particles of sand. Such a method has been disclosed in our published British Patent Specification No. 2,044,598A.

In the performance of this method in an economic manner however difficulty has been experienced in thrusting shoes to any appreciable depth in the bath because the fluidized material exerts a pressure and is not readily displaceable in bulk.

In order to overcome this difficulty it is proposed, in accordance with the present invention, that the shoes should not be specially protectively wrapped but that instead they should be inserted from above into fixed flexible impermeable sleeves with closed lower ends which are immersed in the fluidized material. These sleeves may be made of plastics or other material suitable for protecting the shoe fabric.

Preferably the closed lower ends of the sleeves, which will normally enclose the heels of the shoes, are secured to the bottom of the bath so that their movement is relatively restricted. The upper ends of the sleeve would be secured above the level of the fluidized material in the bath.

Also in accordance with the invention it is proposed that the fluidizing bath should have a cover of impermeable material extending around the sleeves to prevent escape of the fluidized material onto the shoes or into the surroundings of the bath.

Preferably the bath has a hot air inlet at the bottom, and at the top an air exhaust orifice with a filter to prevent escape of the fluidized material through the orifice.

Figure 1:
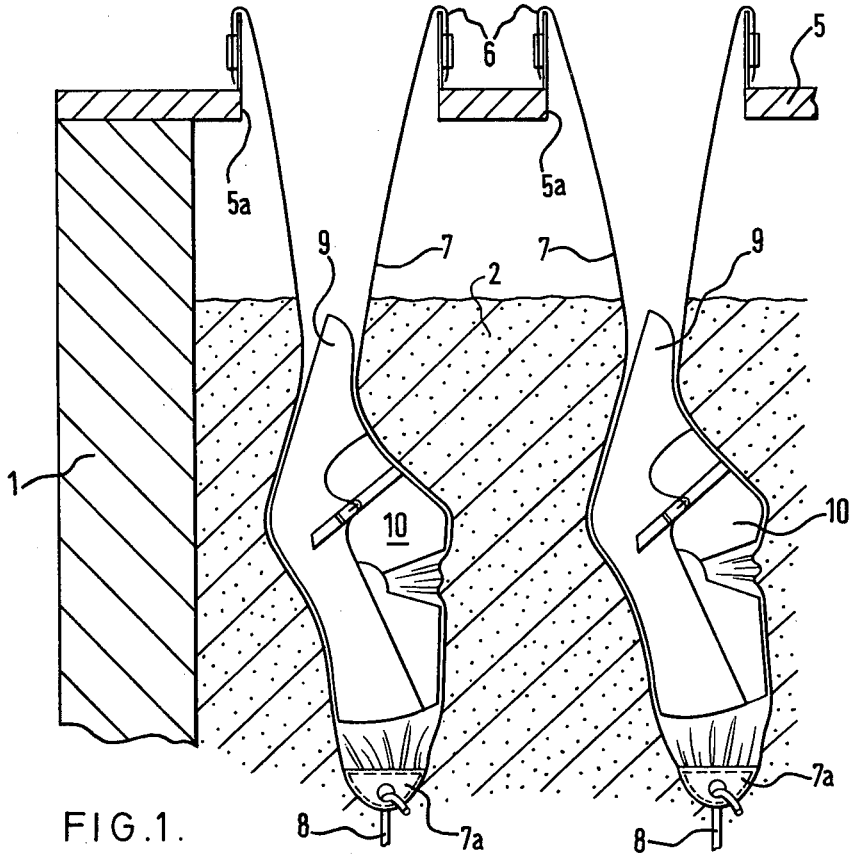
Figure 2:
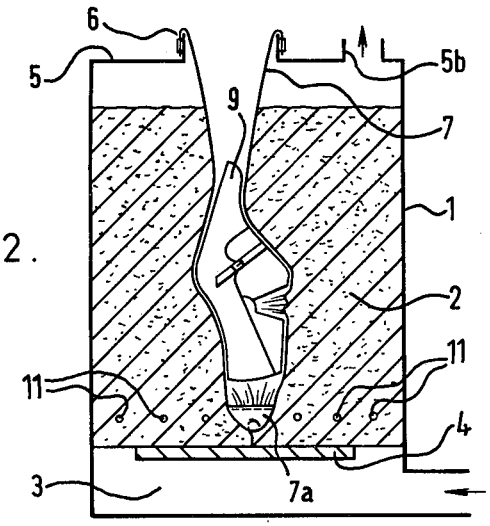

A particular and at present preferred embodiment of the invention is hereinafter described by reference to the accompanying drawings in which:

FIG. 1 is a fragmentary vertical section of a fluidizing bath with shoes immersed therein; and FIG. 2 is a reduced scale cross-section of the bath shown in FIG. 1.

Referring now to the drawings there is shown a bath 1 containing sand or other finely divided thermally retentive material 2 which is capable of being fluidized by admission of hot air or other gas which is supplied (FIG. 2) by way of an inlet pipe 3 and a porous plate 4 to the bottom of the bath 1.

The bath 1 has a top cover 5 provided with a series of apertures 5*a* and an exhaust air outlet 5*b* which would incorporate a filter (not shown) to prevent loss of sand with the exhaust air. The bath 1 also contains heating elements 11 just above the porous plate 4.

Each opening 5*a* is surrounded by a circular clamping device 6 which serves to secure by its upper open end a sleeve 7 which is made of polyurethane coated nylon fabric or some other flexible and impermeable sheet material. The lower closed ends 7*a* of these sleeves 7 are anchored to the base of the bath 1 by retaining hooks 8.

The provision of these sleeves 7 considerably facilitates the immersion into and removal from the bath of the shoes 9 mounted on lasts 10 without adversely affecting the efficiency of the fluidized material heat treatment.

Although the treatment of shoes has been specifically mentioned herein for convenience it is to be understood that the invention is equally applicable to other types of outer footwear.

I claim:

1. A method for manufacturing outer footwear, such as a shoe, which includes the step of dry or moist heat setting a lasted shoe, said method comprising:

inserting the shoe from above into the open end of a sleeve of flexible impermeable material having a closed lower end and which is fixed in position at its open end so as to be suspended with the shoe therein; and wholly or partially immersing said shoe and sleeve in a heated fluidized solid material contained in a bath.

2. Apparatus for dry or moist heat setting a lasted shoe, said apparatus comprising:

a bath of fluidizable material, a plurality of shoe-receiving sleeves made of flexible impermeable material, the upper ends of the sleeves being open and fixed in position relative to the bath, the lower ends of the sleeves being closed, the remainder of the sleeves including their closed lower ends being at least partially immersed in the fluidizable material, and means for admitting heated air to the bath to cause fluidization of the material and thereby heat setting of shoes contained in the sleeves.

3. Apparatus for dry or moist heat setting a lasted shoe comprising a bath of fluidizable material, a plurality of shoe-receiving sleeves made of flexible impermeable material, the upper ends of the sleeves being open and fixed relative to the bath while the remainder of the sleeves, including their closed lower ends, are wholly or partially immersed in the fluidizable material, means for admitting heated air to the bath to cause fluidization of the material and thereby heat setting of shoes contained in the sleeves, including means for securing the closed ends of the sleeves to the bottom of the bath.

4. Apparatus in accordance with claim 2 and further comprising a bath cover made of impermeable material extending around and supporting the open ends of the sleeves to prevent escape of the fluidized material onto the shoes or into the surroundings of the bath.

5. Apparatus in accordance with any of claims 2, 3 or 4 wherein the bath has a hot air inlet at the bottom and an air exhaust orifice at the top, said air exhaust orifice having a filter for preventing escape of fluidized material through the orifice.

* * * * *